United States Patent [19]

LaMonica et al.

[11] 4,448,598

[45] May 15, 1984

[54] PNEUMATIC SYSTEM FOR OPERATING THE MECHANISM OF ICE SEPARATION FROM EVAPORATING PLATES IN A PLATE OR SLAB ICE GENERATOR BY USING THE CONDENSING GAS, SIMULTANEOUSLY WITH CIRCUIT REVESAL FOR DEFROSTING THE ICE PRODUCT

[75] Inventors: Gaspare LaMonica, Brugherio, Italy; Federico Richelli, deceased, late of Milan, Italy; by Angelo Richelli, heir, Segrate, Italy; by Giorgio Richelli, heir; by Fabrizia Richelli, heir, both of Milan, Italy; by Mauro Richelli, heir, Napoli, Italy; by Matilde Orini, heir, Milan, Italy

[73] Assignee: Samifi Babcock Samifi Internationale S.A., Paris, France

[21] Appl. No.: 352,235

[22] Filed: Feb. 25, 1982

[30] Foreign Application Priority Data

Feb. 27, 1981 [FR] France ..... 81 04036

[51] Int. Cl.³ ..... F25C 5/10

[52] U.S. Cl. ..... 62/352; 62/353

[58] Field of Search ..... 62/71–73, 62/352, 353, 66, 340

[56] References Cited

U.S. PATENT DOCUMENTS

| | | | |
|---|---|---|---|
| 2,368,675 | 2/1945 | Muffly | 62/73 |
| 3,055,185 | 9/1962 | Lundstrom | 62/352 X |
| 3,216,218 | 11/1965 | Cornelius | 62/353 X |
| 3,306,072 | 2/1967 | Dahlgren et al. | 62/353 X |
| 3,388,560 | 6/1968 | Moreland | 62/72 X |
| 3,404,543 | 10/1968 | Diblick | 62/72 X |
| 3,877,242 | 4/1975 | Creager | 62/352 X |
| 4,274,263 | 6/1981 | Goushaw | 62/71 |

*Primary Examiner*—William E. Tapolcai

*Attorney, Agent, or Firm*—Robert E. Burns; Emmanuel J. Lobato; Bruce L. Adams

[57] ABSTRACT

A device for separating and moving the ice plates away from the evaporating plates in a machine, wherein said plates of ice are formed in contact with said plates, comprising means for supplying gas from the condensor of the refrigerating system, and accordingly at high pressure, both to the inside of the plates and to act on mechanical means for acting upon the ice plates, so that the separation and removal of the ice plates from the plates is provided by two combined actions, of which one consists of yielding through the plates an amount of heat to the ice causing an initial separation of the ice plates or slabs, while the other action from the fluid causes the operation of said mechanical means, thus exerting a thrust on the ice plates or slabs.

19 Claims, 13 Drawing Figures

PNEUMATIC SYSTEM FOR OPERATING THE MECHANISM OF ICE SEPARATION FROM EVAPORATING PLATES IN A PLATE OR SLAB ICE GENERATOR BY USING THE CONDENSING GAS, SIMULTANEOUSLY WITH CIRCUIT REVESAL FOR DEFROSTING THE ICE PRODUCT

FIELD OF INVENTION

This invention relates to a device for ice separation from the evaporating plates in a plate or slab ice forming machine, both where the plates are immersed in a water containing basin or tank, and where said plates are not immersed in a basin or tank, but are continuously sprayed with water.

BACKGROUND OF THE INVENTION

In such prior art machines means are provided for said separation of the ice plates or slabs from the evaporating plates, but said means have a substantial degree of complications both as to installation, and as to the machine operation.

Particularly, should for ice separation from the evaporating plates determined electric or mechanica apparatuses be used as involving cams, such as for example in the Italian Pat. No. 565,620 and in the prior Italian Pat. No. 543,638, which would substantially form complementary apparatuses, suitably made for such a purpose, the same would as above mentioned involve problems relating to installation and operation.

SUMMARY OF THE INVENTION

It is the essential object of the present invention to remove the above mentioned disadvantages by means which are particularly simple and functional.

According to the present invention, the device is essentially characterized by using the same fluid of the refrigerating system and, to this end, comprising means for supplying hot gas from the condenser of the refrigerating system, and accordingly at high pressure, both to the inside of the plates for initiating the ice separation therefrom, and acting on mechanical means in turn for acting on the ice plates or slabs, whereby the separation and removal of the ice plates or slabs from the plates is provided by two simultaneous combined actions, of which one of heat exchange through the plates and consisting of yielding a sufficient amount of heat to the ice for causing an initial separation from the evaporating plates, while the other action consists of a pneumatic action from the fluid, withdrawn at gas stage from the condenser, whereby said hot fluid acts on said mechanical means, so as to exert a thrust on the ice plates or slabs.

BRIEF DESCRIPTION OF THE DRAWINGS

For a better illustration of these and other features of the device according to the present invention, an exemplary embodiment of the device according to the invention will now be described with reference to the accompanying drawings, in which.

DESCRIPTION OF PREFERRED EMBODIMENT

Figure 1:
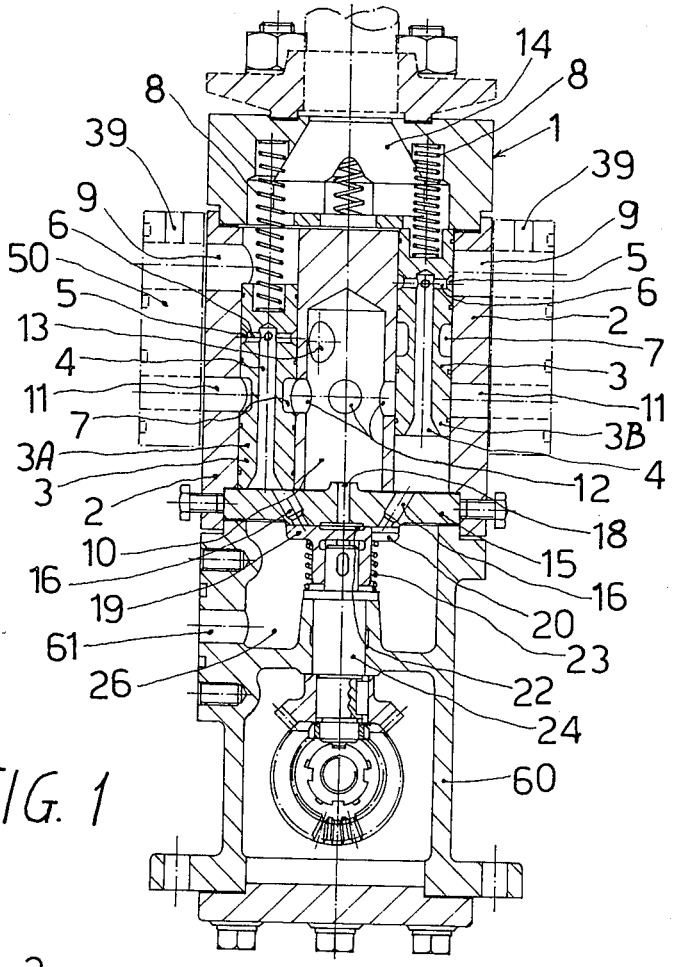
FIG. 1 is a vertical sectional view of an assembly which in the present disclosure is referred to as a distributor.
Figure 2:
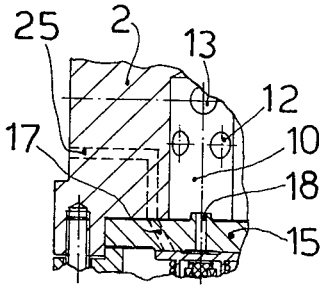
FIG. 2 is a sectional detail view of said distributor.

In the accompanying drawings, the distributor is designated as a whole by 1.

More particularly, said distributor 1 comprises a main body, designated by 2, which houses various members, to be described in the following.

This body 2 accomodates in suitable seats movable plungers, each of which designated by 3. In this example there are four plungers, all of which designated by 3.

It should be understood that the number of plungers 3 may be different from that indicated. Each plunger 3 movable in the direction of its own axis has an axial hole 4 communicating with radial small holes 6, in turn communicating with a peripheral annular cavity 5 opening to the outside. The plunger or each plunger 3 also has a further annular cavity shown by 7.

At each plunger 3 a spring 8 is provided, which reacts between a fixed wall of the above mentioned body 2 and plunger, so as to exert a pressure on the latter.

A conduit 9 and a conduit 11 are provided at each plunger 3, which conduits pass through both the wall of said body 2 and a small block 50 secured to said body 2, whereby four of such small blocks 50 are provided in this exemplary embodiment.

The conduit 9 is connected to an assembly of evaporating plates 62 immersed in the basin or tank where ice is formed. The conduit 11 is also connected to said assembly of evaporating plates.

More particularly, in said basin or tank a series of evaporating plates are provided for ice formation, which ice is formed when frigorigen fluid is supplied to the evaporating plates, the latter being immersed in water.

Thus, an assembly of said evaporating plates, for example four evaporating plates will correspond to a plunger 3 whereby, as discussed below, when the plunger moves to a position at which it enables the supply of frigorigen fluid to the corresponding assembly of evaporating plates, which are immersed in water, ice plates or slabs will be formed at said evaporating plates.

The above mentioned conduits 9 and 11, corresponding to a plunger 3, just communicate with all of the evaporating plates making up the assembly of evaporating plates 62 corresponding to said plunger.

A chamber 10 is provided in said body 2, at which the frigorigen fluid in liquid state arrives through a hole 13. When a plunger 3 moves to the low or bottom position, indicated at 3A, the frigorigen fluid passes from said chamber 10 through a hole 12 to the annular cavity 7, and therefrom to the conduit 11, thus arriving, as discussed below, at the evaporating plates of the assembly corresponding to the involved plunger 3.

When the plunger 3 is at said position 3A, the conduit 9 communicates with a hole 14 communicating with the separating device 64, so that the fluid evaporated in the evaporating plates arrives through the conduit 9 at the hole 14 and then at the separating device.

The above mentioned body 2 is integral with a plate 15, the latter having holes 16 and small holes 17 passing therethrough. In this exemplary embodiment, four holes 16 and as many small holes 17 are provided. Each hole 16 corresponds to a plunger 3 and communicates with the chamber in which a corresponding plunger 3 is located. Each small hole 17 communicates with a corresponding hole 25, to be discussed about in the following, formed in said body 2.

A distributing disc 19 is provided, as keyed on a shaft 24 driven to rotate at constant speed. This distributing disc 19 has a cut 20 and a groove 21 communicating with a cavity 22, in turn communicating with said chamber 10 by a hole 18 passing through the above mentioned plate 15.

A spring 23 presses the distributing disc 19 against said plate 15, or assures the contact between said disc and plate. Reference numeral 26 designates a chamber within a body 60 integral with said body 2, at which the hot gas at the high pressure of the refrigerating circuit described below arrives through a hole 61. The term "hot gas", many times used in the present disclosure, means the frigorigen fluid in gas state withdrawn from the high pressure side of the refrigerating system (condenser).

Figure 6:
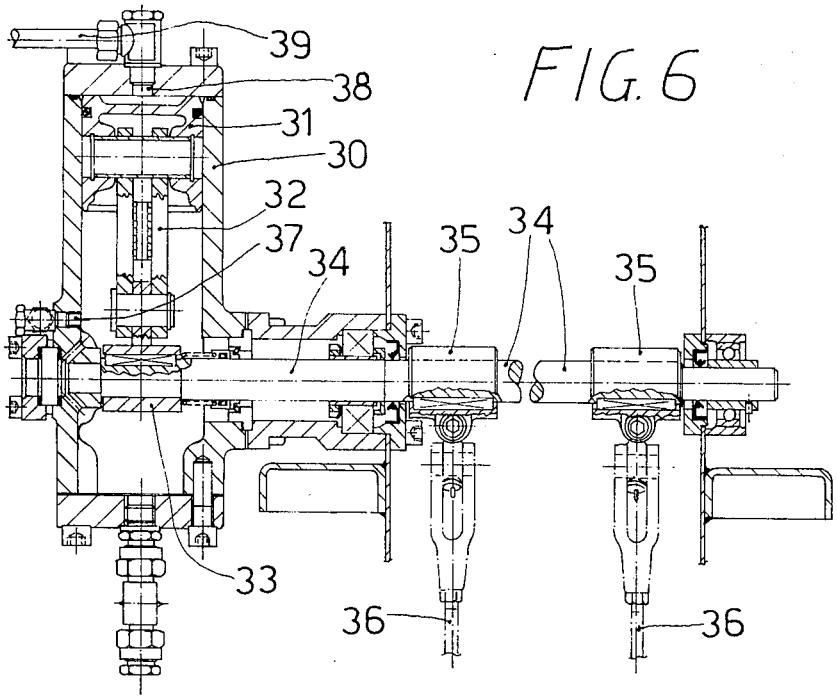
FIG. 6 is a vertical sectional view showing an assembly which in the present disclosure is referred to as an elevating or lifting device.
Figure 5:
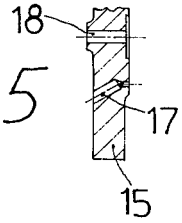
FIG. 5 is a sectional detail view of said plate shown in FIG. 4.
Figure 4:
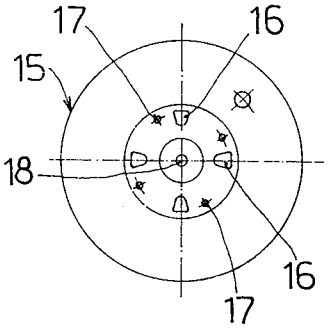
FIG. 4 separately shows a plate also forming part of the distributor.
Figure 3:
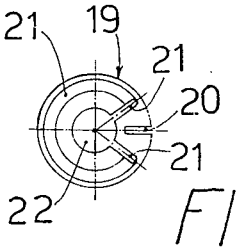
FIG. 3 separately shows a disc forming part of the distributor.

An elevating or lifting device is provided, as comprising a cylindrical body 30 having a movable piston 31 accommodated therein, to the stem 32 of which a connecting rod 33 is connected (FIG. 6). The latter is keyed on a shaft 34, to which two connecting rods 35 are keyed, that are respectively connected to two rods 36, in turn connected to a basket 36A designed through its elevation, as discussed in the following, to elevate or lift the ice plates or slabs formed between the above mentioned evaporating plates 62 that owing to the frigorigen liquid supplied thereto have caused the ice formation.

Reference numerals 37 and 38 designate conduits through which the fluid arrives at the cylindrical body 30, respectively under the piston 31 and on the same, that is at the bottom and top portions of said distributing device.

Indeed, there are as many elevating devices, such as that above described, as the plungers 3. Therefore, in this exemplary embodiment there are four elevating or lifting devices, each of which corresponds to a plunger 3 and is designed to elevate or lift a corresponding basket and accordingly an assembly of ice plates or slabs.

A conduit 39 branches off from each conduit 9 and communicates with said piston 31. In other terms, four conduits 39 branch off from the four conduits 9, corresponding to the four plungers 3, which are constantly respectively connected to the four conduits 38 of the four elevating or lifting devices.

Each hole 25 communicates with a corresponding conduit 37 and hence with the bottom portion of the corresponding piston 31, that is the four holes 25 respectively communicate with the four conduits 37 of the four elevating or lifting devices.

Figure 13:
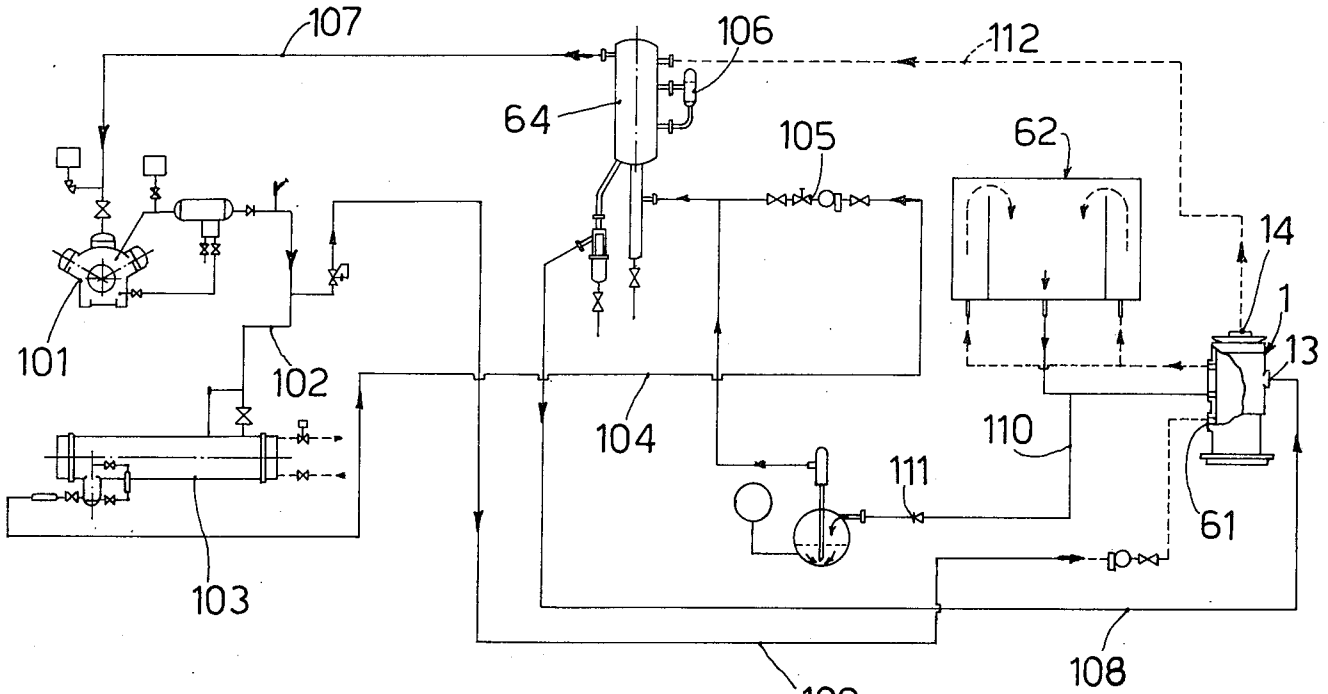
FIG. 13 is a schematic circuit diagram showing a refrigeration circuit in which the ice separating system of the invention is connected.

The refrigeration circuit shown by way of example in FIG. 13 comprises a compressor 101 connected by a line 102 to a condenser 103. The condenser 103 is connected by a line 104 with the separator-accumulator 64 shown in FIGS. 10 and 11. The separator-accumulator 64 is in effect a gas-liquid separator in which refrigerant in gas phase is separated from refrigerant in liquid phase. The supply of liquid refrigerant from the condenser 103 to the separator accumulator 64 is regulated by a valve unit 105 controlled by a liquid level control 106 so as to keep the level of liquid in the separator-accumulator within a predetermined range. Gaseous refrigerant is conducted by conduit 107 from the separator accumulator 64 to the compressor 101. Liquid refrigerant is delivered from the separator-accumulator 64 to the distributor 1 by a line 108. Hot gaseous refrigerant under pressure is delivered from the compressor to the distributor 1 by line 109. Condensate from the plates 62 is conducted to the separator-accumulator 64 by line 110 in which there is a valve 111 corresponding to the valve shown in FIG. 8 or the alternative valve shown in FIG. 9. Gaseous refrigerant from the evaporating plates 62 is conducted from the distributor 1 to the separator-accumulator 64 by the line 112.

The operation of the above described device is substantially as follows.

Assume, for example, to consider the step of normal ice formation.

As above pointed out, in the exemplary embodiment the machine comprises a basin or tank which is supplied with water. In this basin or tank there are vertical parallel evaporating plates 62 provided, which are intended to cause the formation of ice plates or slabs. The ice is formed at those evaporating plates, in turn corresponding to the plungers 3, which are lowered, that is are at the position of the plunger 3 designated at 3A.

Figure 10:
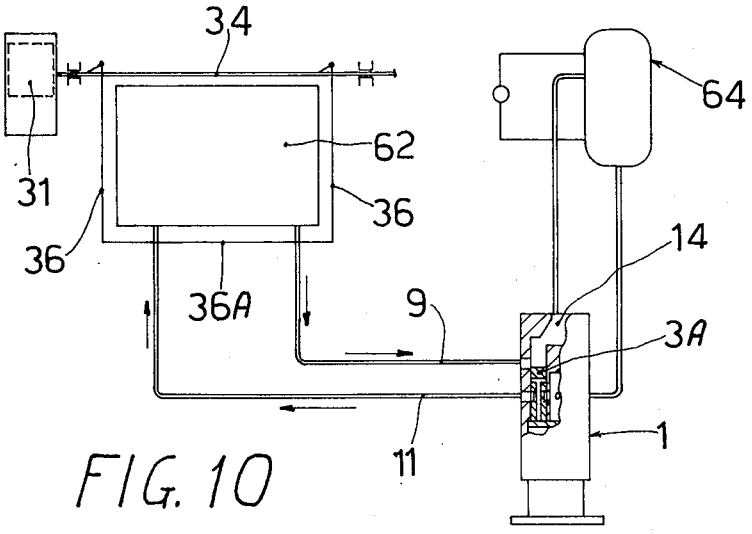
FIG. 10 is a quite schematic view showing an assembly of essential parts of the machine at the step where the ice is formed.

Therefore, assume to consider a plunger 3 at said position 3A (see FIGS. 1 and 10).

The frigorigen fluid at liquid state arrives through the hole 13 at said chamber 10. Thus, the frigorigen fluid arrives from said chamber 10 through a hole 12 at the annular cavity 7 of the plunger 3 and from said annular cavity passes to the conduit 11. Through the latter, said fluid arrives at the assembly of evaporating plates 62, for example four, corresponding to the plunger 3, that is the frigorigen fluid arrives at the inside of each of said plates 62 making up said assembly. This step is schematically shown in FIG. 10.

At said evaporating plates, the ice is formed owing to the provision of said fluid therein. The fluid evaporated in said plates 62 returns through the conduit 9 corresponding to the involved plunger 3, and through the hole 14 arrives at the separating device 64, shown in FIG. 10.

As above mentioned, each conduit 9 is connected by a corresponding conduit 39 and a corresponding conduit 38 to the top portion of piston 31 of the corresponding elevating or lifting device. Therefore, since the fluid from the plate 62 travelling through the conduit 9 corresponding to the plunger 3 is at low pressure, as result also at the top portion of the corresponding elevating or lifting device, that is on the piston 31 of said elevating or lifting device, a low pressure is prevailing.

At the involved step, or step of normal ice formation, the holes 16 and 17 of the plate 15 corresponding to the plunger 3 are both in communication with the groove 21 and accordingly with the chamber 10.

Thus, the following conditions occur.

(A) In the hole 4 of the plunger 3 there is a low pressure, as at this step said chamber 10 communicates through the hole 18, the cavity 22, the groove 21 and the hole 16 with said hole 4. The action of spring 8 prevails on said plunger 3, which therefore remains at lowered position.

(B) Through the small hole 17, corresponding to said plunger 3, said low pressure fluid arrives at the corresponding conduit 37, whereby said low pressure arrives at below the piston 31 of the elevating or lifting device, corresponding to the involved plunger 3. As above mentioned, low pressure also prevails above the piston 31, so that said piston 31 remains at top position as retained by the basket weight, outlined and indicated at 36A, which is at the bottom at said step where the ice formation occurs.

The above conditions last throughout the time during which the cut or slit in disc 19 is between a hole 17 and the subsequent hole 16.

After the above described ice formation step, there is a succesive step for separating from the evaporating plates the ice plates or slabs being formed thereat.

When the slit 20 of the rotating disc 19, or distributor disc, starts to expose a hole 16, then the hot gas or high pressure gas in chamber 26 passes through said hole 16 and arrives at the chamber where the corresponding plunger 3 is located.

Therefore, high pressure will act upon said plunger, urging it upward and, since said pressure is such as to overcome the action of the corresponding spring 8; the plunger 3 is lifted.

Figure 11:
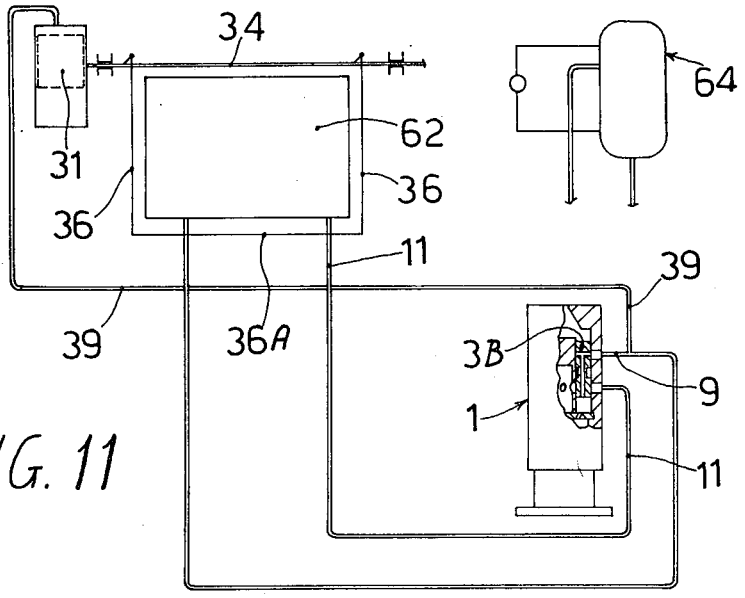
FIG. 11 is a view showing a similar assembly at the step of defrost beginning, that is at the beginning of the step leading to the separation of the ice plates or slabs from the evaporating plates.

Thus, the involved plunger is at the high position, such as that of the plunger indicated at 3B (see FIGS. 1 and 11).

The radial holes 6 and the peripheral annular cavity 5 of the plunger will thus be at the conduit 9, whereby the hot gas from the chamber 26 through the hole 16, as above mentioned, passes through the holes 6 and said cavity 5 from the hole 4 to the conduit 9, and therefrom to the plates 62, or arrives at the inside of each of the plates 62 of the assembly corresponding to the involved plunger 3.

The previously formed ice adheres to said plates 62 and therefore has to be separated therefrom, or the ice plates or slabs have to be released for floating in said basin or tank, and then be withdrawn and discharged out of the basin or tank.

As above mentioned, when the hot gas arrives at the plates, it will start to yield heat to the ice and begin a separation action, but the separation not being immediate.

In addition, when the hot gas from said holes 5 and cavity 6 of the involved plunger 3 arrives at the conduit 9, it clearly appears that some gas will penetrate into the conduit 39 branching off from said conduit 9, thus arriving at the conduit 38 and therefrom at the top portion of the corresponding elevating or lifting device. In other terms, said hot gas or high pressure gas comes into contact with the top portion of the piston 31, thus downward pressing the latter, step schematically shown in FIG. 11.

Low pressure prevails below said piston 31. This piston 31 would tend to move downwards, the downward movement of the piston would cause the shaft 34 to rotate in the direction in which the rods 36 would be raised or lifted, which rods are connected at the bottom to the basket 36A corresponding to the plate assembly 62 of the involved plunger 3 located at said top position, as that indicated at 3B.

As a matter of fact, firstly said piston 31 does not downward move, as hindered by the ice resistance, that is while upward pressing or urging said ice, said basket 36A is not allowed to move upwards, since said ice is still attached or adhering to the plates 62. This occurs for a short initial time, even if said plates 62 receive the hot gas which, as above mentioned, starts to separate such ice from the plates.

On the other hand, the hot gas from inside the plates continues to yield heat to the ice for separation thereof therefrom, while the hot gas or high pressure gas downward presses or urges the piston 31, so that the basket 36A urges the ice upward. As evident, at some point the ice separates from the plates 62.

Figure 12:
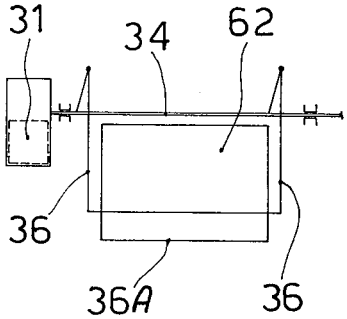
FIG. 12 is still a quite schematic view showing a detail of said assembly at the end of the separating step for the ice plates or slabs from the evaporating plates.

At this time, said piston 31 downward moves, causing said shaft 34 to rotate and, as a result, the lifting of the basket 36A. Thus, the latter lifts a unit of ice plates or slabs, with the elevating or lifting device being at this time at the conditions shown in FIG. 12.

Then, the ice plates or slabs arrive at the surface of water in the basin or tank in which said evaporating plates are immersed and accordingly float and are successively withdrawn therefrom by suitable means.

As long as said slit or cut 20 is at said hole 16, hot gas is supplied to the plates 62. When said slit or cut 20 is no longer at said hole 16, no more will the hot gas upward press or urge the plunger 3, and therefore said plunger 3 will lower again under the action of said spring 8 and its own weight.

In other terms, no longer does the hot gas arrive at the conduits 9 and 39.

The gas which was under the plunger 3 is exhausted through the groove 21 and cavity 22 which by the hole 18 is in communication with the chamber 10, in which low pressure prevails. Just a short time after, the cut or slit 20 arrives at a small hole 17 and through the latter the hot gas passes to the corresponding hole 25, with a hole 25 corresponding to each of the small holes 17.

From said hole 25 the hot gas passes to the conduit 37 of the corresponding elevating or lifting device and thus will press or urge the piston 31 upward.

On the other hand, the top portion of the elevating or lifting device is in communication with low pressure, or the latter exerts its action on the piston 31. Thus, as above mentioned, said plunger 3 is lowered, or is at a position such as that indicated at 3A.

Thus, the action of high pressure prevails below the piston 31 and urges the latter upward, whereby such a pistion is lifted, causing said shaft 34 to rotate in the direction to cause a downward movement of the basket. Therefore, it is said hot gas that provides for a fast return or backwards movement of the basket.

A device is also provided for discharging the condensate being formed in the plates during the defrosting step.

In each of the four blocks 50 in which the conduits 11, 9 and 39 are located, provision is made for a conduit 51 communicating with the conduit 11 and a conduit 52, the latter having a small ball 53 at one end thereof.

When the condensate being formed in said plates 62 arrives at the conduit 11, it also arrives at the conduit 52 and raises said small ball 53, so that through a conduit 54 said condensate arrives at the plate supply separator through a pressure adjusting valve.

Figure 9:
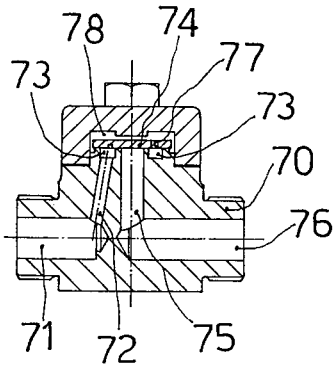
FIG. 9 is a sectional view showing a further device which may be used for discharging said condensate.
Figure 7:
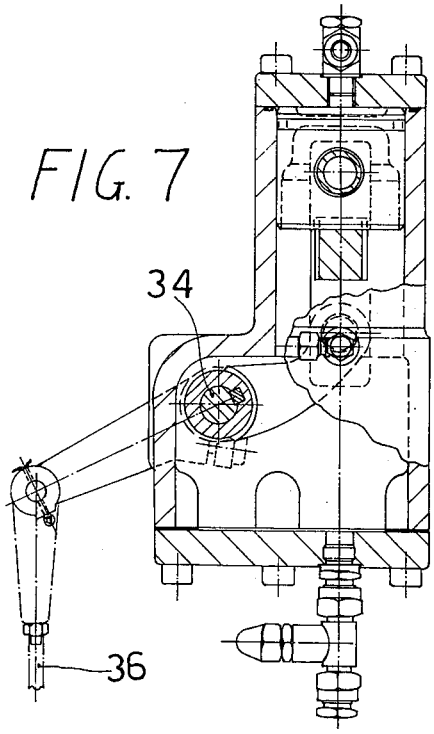
FIG. 7 is a further vertical sectional view of the elevating or lifting device.
Figure 8:
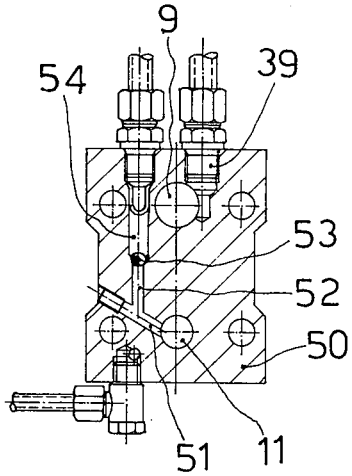
FIG. 8 is a sectional view of a device for discharging the condensate being formed in the plates during defrosting step.

A device, such as that shown in FIG. 9, can be used instead of the condensate discharging device of FIG. 8, comprising said small ball 53. Such a device comprises a body 70, having therein a conduit 71, along which at some time said condensate arrives. A conduit 72 branches off from said conduit 71 and communicates with an annular chamber 73. Reference numeral 74 designates a small disc, merely bearing on a surface of said body 70. This small disc 74 has a small hole 77 passing therethrough. On arrival of the gas mass through the conduit 71, such a gas mass passes through the conduit 72, the annular chamber 73 and the hole 77, thus reaching a chamber 78.

Therefore, said small disc 74 is not lifted, since the force being exerted by said gas mass from the chamber 78 on the small disc 74 in downward direction overcomes the force that from the annular cavity 73 said gas mass exerts on the small disc in upward direction, that is in said chamber 78 a pressure is exerted on the circular surface of the small disc 74, while a pressure from the annular chamber 73 is exerted only on a circular crown. On the other hand, when the liquid mass arrives through the conduit 71, said small disc 74 is lifted and the liquid or condensate passes through the conduits 75 and 76 directed to the plate supply separator.

As above mentioned, the separation of the ice plates or slabs from the evaporating plates and the removal thereof from said evaporating plates are provided by two combined distinct actions, and particularly a heat exchange action being carried out on the ice through the plates, and a pneumatic action, then converted to a mechanical action, being also carried out on the ice by the above described elevating or lifting device.

It is basically significant that use is made of the hot gas, that is the same frigorigen fluid at gas state from the high pressure side of the system (condenser) for providing both of the above described actions, that is the gas temperature and pressure are used for providing said heat exchange action and said pneumatic action, which actions lead to the separation and removal of ice from the evaporating plates.

The withdrawal of said hot high pressure gas is immediate upon cycle reversal, that is when cycle reversal occurs at the end of the ice formation step some hot gas reaches the evaporating plates through the conduit 9 to provide said heat exchange action causing a partial defrosting, while a part of said hot high pressure gas reaches through the conduits 39 and 38 the top of the elevating or lifting device to provide said pneumatic action, which is converted to mechanical action on the ice for removing the latter from the plates. As above mentioned, said hot gas is also used for fast return of the baskets to the lower position, after the latter have caused the ice to move away from the evaporating plates by the mechanical action thereof.

Thus, apparent is the advantage of using the above described hot gas, or the factors relating thereto, such as temperature and pressure, also taking into account that such a gas is anyhow available in the system, and its use is carried out by the above described means of simple structure and reliability.

Therefore, no use is required of electric and mechanical apparatuses, such as those provided in the above mentioned prior art patents, which apparatuses would be of complementary nature and involve complications in installation and normal operation of the machine.

Of course, in addition to the exemplary embodiment above described with reference to the accompanying drawings, many other embodiments are possible still within the scope of the present invention.

Thus, for example, the device according to the present invention can be adapted also to machines for forming ice plates or slabs comprising evaporating plates not immersed in a basin or tank. Furthermore, different may be the means for supplying hot gas to within the plates for producing the heat exchange to initiate the ice separation, and acting upon the mechanical means for exerting a thrust or pressure on the ice plates or slabs. Particularly and by mere way of example, instead of the above described means comprising the distributing disc 19 and other above described members (see, for example FIG. 1), the use can be provided of means, such as for example electrovalves controlled by cyclical motors, or other electric systems cyclically providing the desired controls.

What is claimed is:

1. In an icemaking machine, the combination of a plurality of hollow evaporating plates, means for supplying to said plates liquid refrigerant for evaporation in said plates to cool said plates and thereby freeze water supplied to said plates to form slabs of ice thereon, pneumatically operable mechanical means engagable with ice slabs on said plates to exert thereon forces directed to remove said slabs from said plates and means for supplying hot gaseous refrigerant under pressure to said plates to heat said plates to release ice slabs therefrom and to said pneumatically operable mechanical means to activate said mechanical means to remove released ice slabs from said plates.

2. A combination according to claim 1, in which said means for supplying liquid refrigerant to said plates and for supplying hot gaseous refrigerant under pressure to said plates and to said pneumatically operable mechanical means comprises cyclically operable means for alternately supplying liquid refrigerant to said plates for a period of time sufficient to freeze slabs of ice thereon and supplying hot gaseous refrigerant under pressure to said plates and to said pneumaticallly operable mechanical means to remove ice slabs from said plates.

3. A combination according to claim 2, in which said cyclically operable means comprises a distributor comprising means for connection to a supply of liquid refrigerant and to a supply of hot gaseous refrigerant under pressure, means connecting said distributor to said plates for alternately supplying to said plates liquid refrigerant to cool said plates and hot gaseous refrigerant under pressure to heat said plates, and means connecting said distributor with said pneumatically operable mechanical means to supply hot gaseous refrigerant under pressure to actuate said mechanical means to remove ice slabs from said plates when hot gaseous refrigerant under pressure is supplied to said plates.

4. A combination according to claim 3, in which there are a plurality of assemblies of said plates and associated ice slab removal means, and in which said distributor comprises a like plurality of movable plungers each controlling flow of liquid refrigerant and hot gaseous refrigerant under pressure to a respective assembly of plates, each of said plungers being movable between a first position for supplying liquid refrigerant to the respective assembly of plates to freeze slabs of ice thereon and a second position for supplying hot gaseous refrigerant under pressure to said respective assembly of plates and associated ice slab removal means to release and remove ice slabs from said plates.

5. A combination according to claim 4, in which said distributor further comprises a body having a plurality of bores, one for each of said plungers, said body further having passageways communicating with each of said bores including passage ways connected with said plates and said ice slab removal means, each of said plungers being movable in a respective bore to control the opening and closing of said passageways to control the supply of liquid refrigerant to said plates to freeze ice slabs thereon and the supply of hot gaseous refrigerant under pressure to said plates and to said ice removal means to remove ice slabs from said plates.

6. A combination according to claim 1, further comprising means for separating liquid refrigerant from gaseous refrigerant and means connecting said plates with said separating means for conducting refrigerant from said plates to said separating means for separation of liquid refrigerant from gaseous refrigerant.

7. A combination according to claim 6, in which said connecting means comprises valve means for blocking flow of gas while permitting flow of liquid.

8. A combination according to claim 7, in which said valve means comprises a valve body, a stepped passage in said valve body having a larger portion and a smaller portion with an annular shoulder between said portions, and a ball in said larger portion and adapted to seat on said shoulder to close said passage, said ball being floatable by liquid so as to be unseated from said shoulder to open said passage.

9. A combination according to claim 7, in which said valve means comprises a valve body, an annular chamber in said body, a second chamber in said body over said annular chamber, a movable disc separating said chambers, said disc having a small hole between said chambers, an inlet passage into said annular chamber, and an outlet passage opening into said second chamber centrally of said annular chamber but normally closed by said disc, whereby gas entering said annular chamber by said inlet passage passes through said hole in said disc into said second chamber and is block by said disc from entering said outlet passage while liquid entering said annular chamber lifts said disc and can thereby flow from said annular chamber to said outlet passage.

10. A combination according to claim 1, in which said ice slab removal means comprises a cylinder to which said hot gaseous refrigerant under pressure is supplied, a piston reciprocable in said cylinder, a rotatable shaft, means connecting said piston with said shaft for rotary oscillation of said shaft upon reciprocation of said piston, means for engaging ice slabs on said plates and means connecting said ice slab engaging means with said shaft for movement to remove ice slabs from said plates upon rotation of said shaft.

11. In an icemaking machine, the combination of a plurality of sets of hollow evaporating plates adapted to be cooled by refrigerant to freeze slabs of ice thereon, pneumatically operable mechanical means associated with said plates and operable to remove ice slabs from said plates, and distributor means for alternately supplying liquid refrigerant to said plates to freeze slabs of ice thereon and supplying hot gaseous refrigerant under pressure to said plates to heat said plates to release ice slabs therefrom and to said removal means to operate said removal means to remove ice slabs released from said plates, said distributor means being operable cyclically to supply refrigerant sequentially to said sets of plates.

12. A combination according to claim 11, in which said distributor means comprises a body having a central chamber, a plurality of parallel bores disposed around said central chamber, there being one of said bores for each set of evaporating plates, an opening between said central chamber and each of said bores, conduits opening into said bores and connected with respective sets of plates and associated ice slab removal means, means supplying liquid refrigerant to said central chamber, means for supplying hot gaseous refrigerant under pressure to said bores, hollow plungers reciprocable in said bores to control the supply of refrigerant to said conduits and means for actuating said plungers sequentially and cyclically.

13. A combination according to claim 12, in which said means for supplying hot gaseous refrigerant under pressure to said bores comprises a second chamber in said body disposed at one end of said bores and separated from said central chamber, a passageway from said second chamber to each of said bores, and rotary valve means normally closing said passageways and operable to open said passageways sequential to admit hot gasious refrigerant under pressure to respective bores.

14. A combination according to claim 13, in which each of said plungers is spring biased to a first position in which it admits flow of liquid refrigerant from said central chamber to a conduit leading to said plates, and is movable by admission to the respective bore of hot gaseous refrigerant under pressure from said second chamber to a second position in which it admits said hot gaseous refrigerant under pressure to conduits leading to said plates and associated ice slab removal means.

15. A combination according to claim 13, in which a partition separates said second chamber from said central chamber and said bores, said passageways from said second chamber to said bores being in said partition and said rotary valve means comprising a rotatable valve member pressed against said partition and having an opening therein, and means for rotating said valve member to bring the opening therein sequentially into registration with said passageways.

16. A combination according to claim 15, in which a central opening in said partition communicates with a central recess in said valve members from which radial grooves extend to positions to register cyclically with said passageways in said partition, whereby each bore is in communication with said central chamber when one of said grooves is in registration with the respective passageway communicating with said bore.

17. A combination according to claim 11, further comprising means for separating gas from liquid, and in which said distributor further comprises means for cyclically connecting said evaporating plates with said gas liquid separating means when liquid refrigerant is supplied to said plates.

18. A combination according to claim 11, in which each of said ice slab removal means comprises a cylinder, a piston reciprocable in said cylinder, a rotatable shaft, means connecting said piston with said shaft for rotation of said shaft upon reciprocable movement of said piston, means for engaging ice slabs on said plates, and means connecting said ice slab removal means with said shaft for movement to remove ice slabs from said plates upon rotation of said shaft, and means connecting one end of said cylinder with said distributor means to receive hot gaseous refrigerant under pressure for movement of said piston in a direction to move said ice slab engaging means from a normal position to an ice slab removal position.

19. A combination according to claim 18, further comprising second connecting means connecting the opposite end of said cylinder with said distributor means, said distributor means further comprising means for supplying gaseous refrigerant under pressure to said opposite end of said cylinder after removal of ice slabs from said plates to return said ice slab engaging means to normal position.

* * * * *